US008667617B2

(12) United States Patent
Glezerman et al.

(10) Patent No.: US 8,667,617 B2
(45) Date of Patent: Mar. 11, 2014

(54) HELMET HAVING EMBEDDED ANTENNA

(75) Inventors: Abraham Glezerman, Tel-Aviv (IL); Avraham Kushnirov, Or-Yehuda (IL); Yossef Twina, Rosh-Ha'ayin (IL)

(73) Assignee: Cardo Systems, Inc., Ra'anana (IL)

( * ) Notice: Subject to any disclaimer, the term of this patent is extended or adjusted under 35 U.S.C. 154(b) by 71 days.

(21) Appl. No.: 13/195,520

(22) Filed: Aug. 1, 2011

(65) Prior Publication Data

US 2012/0272436 A1 Nov. 1, 2012

Related U.S. Application Data

(63) Continuation-in-part of application No. 13/096,281, filed on Apr. 28, 2011.

(51) Int. Cl.

| | |
|---|---|
| ***A42B 3/30*** | (2006.01) |
| ***A42B 3/06*** | (2006.01) |
| ***H01Q 1/22*** | (2006.01) |
| *A42B 3/04* | (2006.01) |
| *H01Q 1/36* | (2006.01) |

(52) U.S. Cl.

USPC ..... 2/410; 2/6.6; 2/422; 343/700 R; 343/700 MS; 343/718; 343/767

(58) Field of Classification Search

USPC ..... 343/700 R, 718, 878; 2/410, 6.1, 6.2, 2/6.6, 411–414, 425, 171, 209.13, 200.1, 2/272, 900, 906

See application file for complete search history.

(56) References Cited

U.S. PATENT DOCUMENTS

| | | | | |
|---|---|---|---|---|
| 3,582,951 | A * | 6/1971 | Altmayer | 343/718 |
| 3,845,389 | A | 10/1974 | Phillips et al. | |
| 5,119,505 | A | 6/1992 | Tisseront et al. | |
| 5,404,577 | A * | 4/1995 | Zuckerman et al. | 455/66.1 |
| 5,438,702 | A | 8/1995 | Jackson | |
| 6,009,563 | A * | 1/2000 | Swanson et al. | 2/425 |
| 7,532,163 | B2 * | 5/2009 | Chang et al. | 343/700 MS |
| 7,750,860 | B2 * | 7/2010 | Mohamadi | 343/718 |
| 2002/0098877 | A1 * | 7/2002 | Glezerman | 455/568 |
| 2004/0204208 | A1 | 10/2004 | Thompson | |
| 2006/0017545 | A1 * | 1/2006 | Volpi et al. | 340/10.4 |
| 2007/0105404 | A1 * | 5/2007 | Lee et al. | 439/37 |
| 2008/0191950 | A1 * | 8/2008 | Chang et al. | 343/718 |
| 2009/0257217 | A1 * | 10/2009 | Harris | 362/105 |
| 2010/0134365 | A1 * | 6/2010 | Mohamadi | 343/718 |
| 2012/0189153 | A1 * | 7/2012 | Kushnirov et al. | 381/375 |
| 2012/0190314 | A1 * | 7/2012 | Glezerman et al. | 455/90.3 |
| 2012/0190315 | A1 * | 7/2012 | Glezerman et al. | 455/90.3 |

* cited by examiner

*Primary Examiner* — Bobby Muromoto, Jr.
(74) *Attorney, Agent, or Firm* — Leason Ellis LLP

(57) ABSTRACT

An enhanced protective helmet includes in one embodiment an outer shell and a molded lining disposed within the outer shell and contoured to surround a human head. The helmet further includes an elongated antenna having a proximal end and a free end, the antenna being supported by the molded lining. The helmet includes a connection point which can be mounted to the molded lining or otherwise extend away from the proximal end of the antenna, the connection point communicatively connected to the proximal end of the antenna. The connection point receives a connection from a mobile communication device, thereby linking the mobile communication device and the antenna. The antenna is located at helmet location that is along one side of the helmet above a left or right ear of the user for optimizing antenna performance.

16 Claims, 6 Drawing Sheets

HELMET HAVING EMBEDDED ANTENNA

CROSS REFERENCE TO RELATED APPLICATION

The present application is a continuation-in-part of U.S. patent application Ser. No. 13/096,281, filed Apr. 28, 2011, which is hereby incorporated by reference in its entirety.

TECHNICAL FIELD OF THE INVENTION

The present invention relates to a protective helmet, and more particularly, relates to a protective helmet incorporating an antenna that is configured to improve the performance of one or more connected mobile devices.

BACKGROUND OF THE INVENTION

It will be appreciated that many types of protective helmets are used across many different industries. For example, hard hats are universally worn by those working at a construction site, as well as by those who operate heavy industrial equipment, etc. Athletes who participate in various sports, such as baseball and football, also wear helmets for protection, and the helmet is one of the most critical pieces of equipment for a professional race car driver. Helmets are also used in many military settings. One of the most commonly used protective helmets in contemporary society is the motorcycle helmet. Most motorcycle riders wear helmets in the interests of safety, as well as due to state and local laws and regulations requiring them.

As is well known, Bluetooth® is an industrial specification for wireless personal area networks (PANs). Bluetooth provides a way to connect and exchange information between devices, such as mobile phones, laptops, personal computers, printers, GPS receivers, digital cameras and video game consoles over a secure, globally unlicensed short-range radio frequency. Many of the most common applications of Bluetooth relate to mobile communications, wherein Bluetooth is used to connect various mobile devices together. However, by virtue of the mobile nature of many of these devices, they frequently incorporate small antennas. As a result of these small antennas, the communication range of many mobile devices is generally quite small. Additionally, various other portable devices, such as portable radios, often sacrifice antenna length (and thus performance) at the expense of portability, resulting in less than optimal performance.

While various Bluetooth headsets have been developed that can be configured for use with protective helmets, none of these products serve to improve or resolve the inherent antenna length limitation of mobile devices.

It is with respect to these considerations and others that the disclosure made herein is presented.

SUMMARY OF THE INVENTION

Technologies are presented herein for an enhanced protective helmet. In one aspect, the helmet can comprise an outer shell, a molded lining disposed within the outer shell which is contoured to surround a human head, and an elongated antenna having a proximal end and a free end, with the antenna being supported by the molded lining. The helmet according to this aspect of the invention can have a connection point mounted to the molded lining, the connection point being communicatively connected to the proximal end of the antenna. The connection point, regardless of whether it is mounted to the lining or otherwise extending away from the antenna proximal end, is configured to receive a connection from a mobile communication device, thereby linking the mobile communication device and the antenna.

According to another aspect, an enhanced protective helmet is provided in which the helmet includes a shaped foam element contoured to surround a human head and an elongated antenna having a proximal end and a free end, with the antenna being supported by the shaped foam element. The helmet can have a connection point mounted to the shaped foam element, the connection point being communicatively connected to the proximal end of the antenna. The connection point, regardless of whether it is mounted to the lining or otherwise extending away from the antenna proximal end, is configured to receive a connection from a mobile communication device, thereby linking the mobile communication device and the antenna.

The antenna is located at helmet location that is along one side of the helmet above a left or right ear of the user for optimizing antenna performance.

These and other aspects, features, and advantages can be appreciated from the accompanying description of certain embodiments of the invention and the accompanying drawing figures.

DETAILED DESCRIPTION OF CERTAIN EMBODIMENTS OF THE INVENTION

The following detailed description is directed to an enhanced protective helmet. In the following detailed description, references are made to the accompanying drawings that form a part hereof, and which are shown by way of illustration through specific embodiments or examples.

Figure 1:
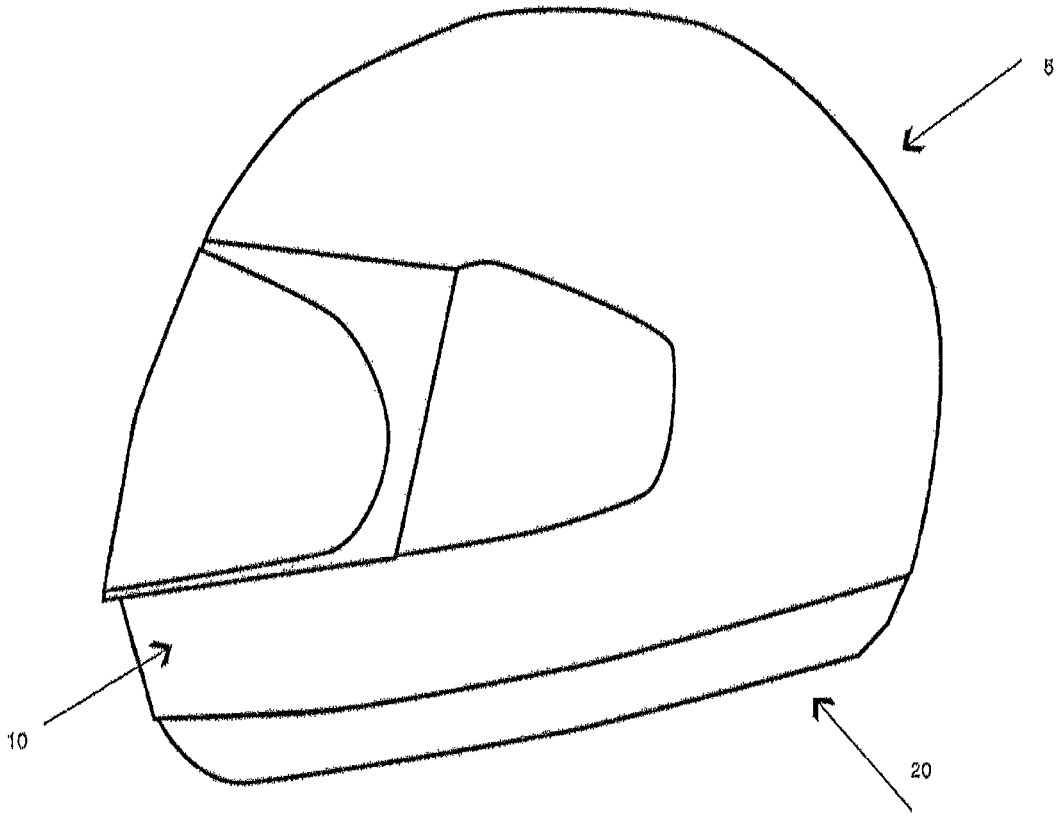
FIG. 1 is an exemplary diagram of an assembled view of an enhanced protective helmet according to one embodiment disclosed herein.

Referring now to the drawings, it is to be understood that like numerals represent like elements through the several figures, and that not all components and/or steps described and illustrated with reference to the figures are required for all embodiments. FIG. 1 is an exemplary diagram of an assembled view of the enhanced protective helmet 5 according to one embodiment disclosed herein. The enhanced protective helmet 5 includes an outer shell 10 which is preferably made from a rigid material such as plastic. Outer shell 10 is the most external protective surface of helmet 5, and serves to protect the wearer's head from direct impact.

Molded lining 20 is preferably disposed within outer shell 10. Molded lining 20 is also preferably shaped and/or contoured to surround a human head, such as the head of the wearer of helmet 5. While it should be readily understood that molded lining 20 can be shaped and/or contoured in practically any way, FIGS. 1-6 depict an exemplary shape/contour scheme for molded lining 20. It should also be noted that various contours on molded lining 20 can be defined for the purpose of better shaping molded lining 20 to fit within outer shell 10.

Preferably, molded lining 20 is constructed from shock-absorbent material such as foam. Such a construction provides the wearer with significant protection from direct impacts, especially when used in conjunction with outer shell 10, as referenced above. It should be noted that while in the present embodiment molded lining 20 has been described as being disposed within outer shell 10, in other embodiments helmet 5 can include molded lining 20 as a standalone shaped foam element that does not require an outer shell 10. In such an embodiment, the external surface of molded lining 20 can be treated and/or coated with various substances which serve to stiffen or otherwise harden the molded lining 20. In yet another embodiment, molded lining 20 can exist independently of outer shell 10 in that molded lining 20 can be contoured, shaped, and/or otherwise configured to be displaced in any number of outer shells 10 which can be obtained independent of molded lining 20.

Figure 2:
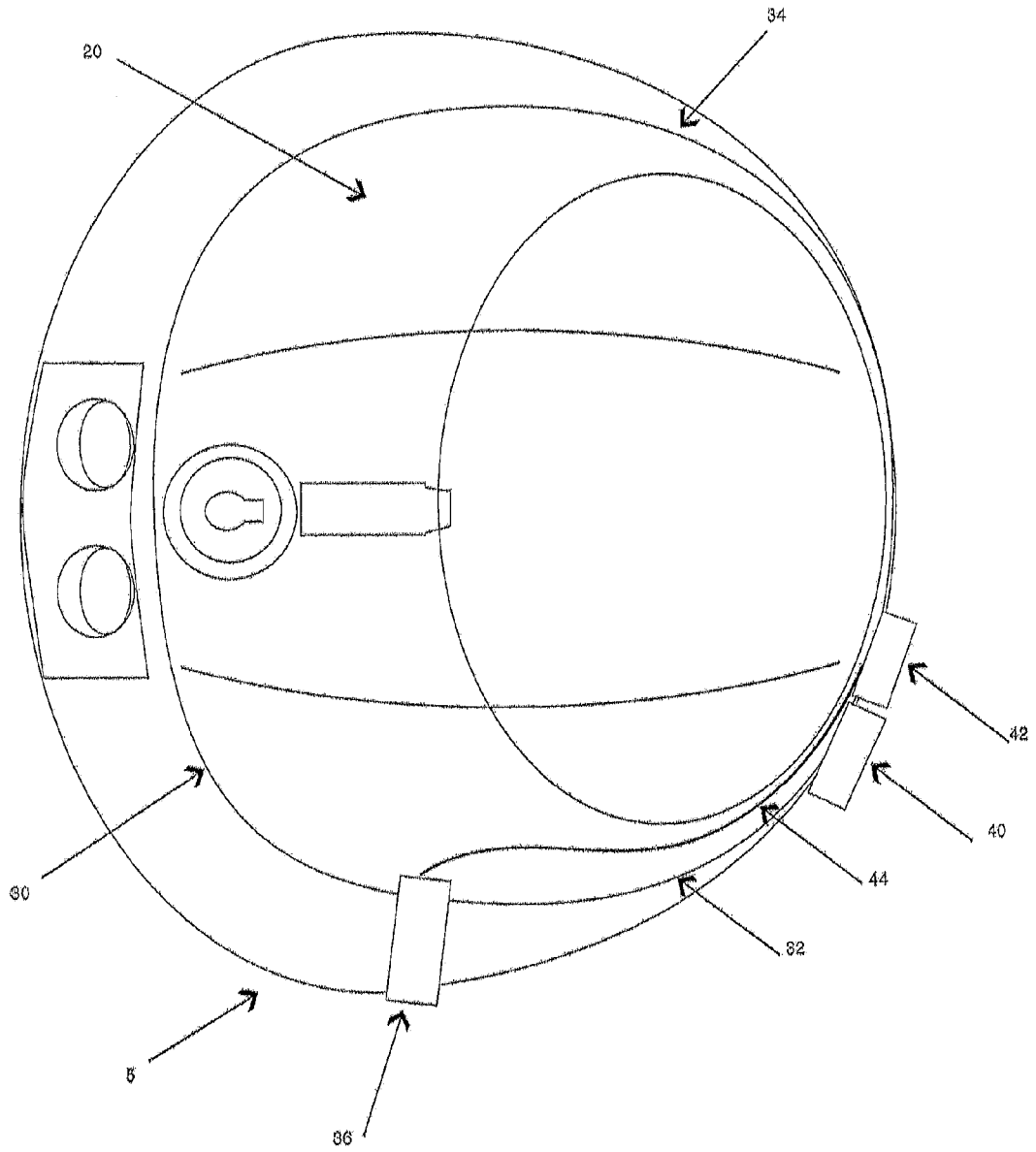
FIG. 2 is an exemplary diagram of a deconstructed view of the helmet according to one embodiment disclosed herein.

Turning now to FIG. 2, an exemplary diagram of a deconstructed view of helmet 5 (having outer shell 10 removed) according to one embodiment is presented. An elongated antenna 30 is preferably supported by molded lining 20. Preferably, antenna 30 consists of one or more metallic conductors/elements. In one embodiment, antenna 30 can comprise a ceramic or ceramic chip antenna. Antenna 30 also preferably has a proximal end 32 that is connectable to a mobile communication device via a connection point 40 (described below) and a free end 34 that defines the end of the antenna's electrical and physical length. Antenna 30 serves to provide additional reception capabilities to a connected device, as will be described in greater detail below.

Figure 3:
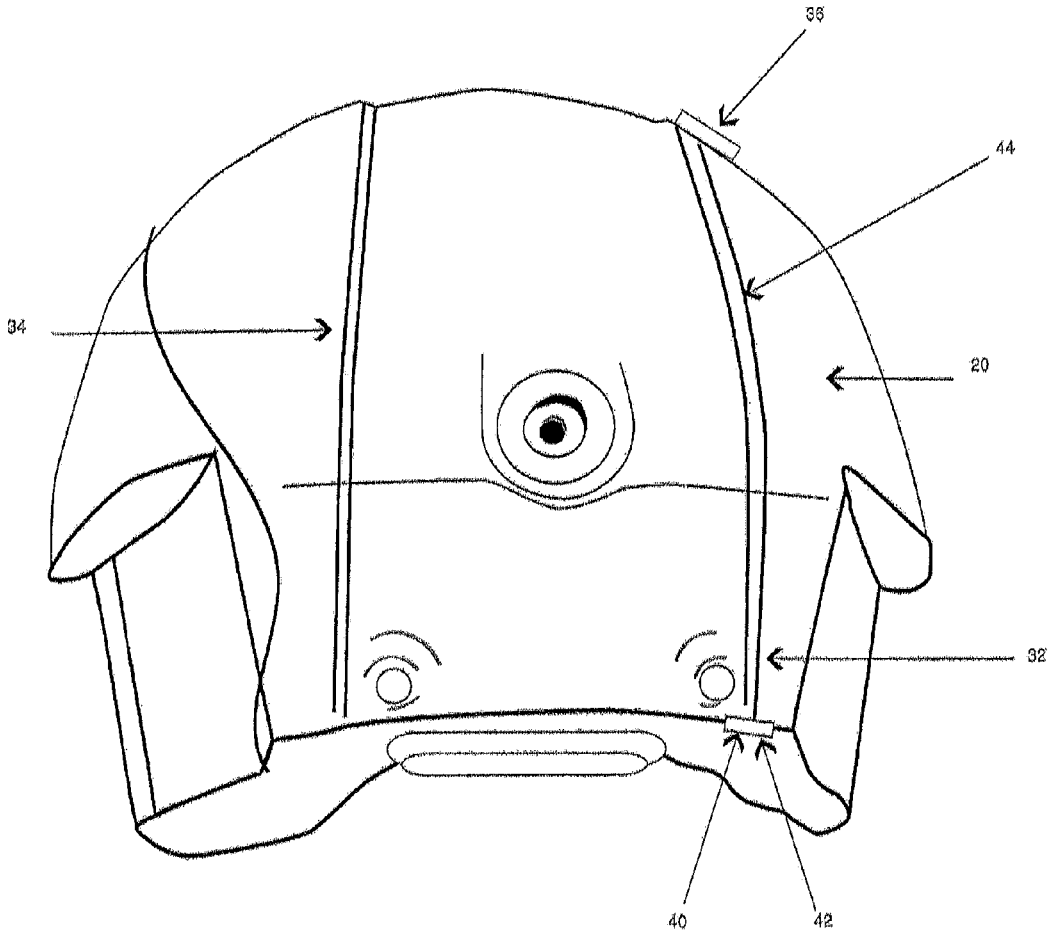
FIG. 3 depicts an exemplary diagram of a back view of a molded lining showing the arrangement of an antenna upon it.

Antenna 30 can be arranged and/or disposed with respect to molded lining 20 in any number of ways. In one embodiment (and as depicted in FIGS. 2-3), antenna 30 is supported across a surface of molded lining 20. In another embodiment, antenna 30 can be embedded within molded lining 20. In yet another embodiment, certain portions of antenna 30 can be supported on molded lining 20, while other portions are embedded within the lining.

Antenna 30 can be practically any device and/or material that is capable of sending and/or receiving electromagnetic waves. In one embodiment, antenna 30 can be a radio frequency (RF) antenna. In another embodiment, antenna 30 can be a frequency modulation (FM) antenna. In yet another embodiment, antenna 30 can be a ceramic or ceramic chip antenna, such as those commonly implemented in Bluetooth and/or mobile devices. Accordingly, it should be understood that antenna 30 can be practically any device and/or material that is capable of sending and/or receiving electromagnetic waves, including but not limited to antennas used in conjunction with RF, FM, and/or Bluetooth transmissions. Additionally, though the present disclosure generally describes antenna 30 in context of a single antenna, it should be appreciated that in alternate arrangements antenna 30 can be embodied as a plurality of antennas.

Thus, antenna 30 can comprise multiple antennas of varying size, shape, and/or type (e.g., RF, FM, and Bluetooth), and the multiple antennas can be arranged in a variety of ways, as will be described in greater detail below.

Additionally, antenna 30 can be arranged and/or configured in any number of ways in order to improve and/or optimize its performance. By way of example, antenna 30 can be configured and/or arranged in a pattern upon (or within—in the case of an embedded antenna) the molded lining 20, such as the pattern depicted in FIGS. 2-3 in which the antenna is arranged and distributed evenly across the surface of molded lining 20. It will be readily appreciated that antenna 30 can be configured in many different arrangements and/or patterns which can serve to improve and/or optimize the performance of the antenna in a particular wireless network or setting. For example, FIG. 3 depicts an exemplary diagram of a back view of molded lining 20 showing the arrangement of antenna 30 upon it.

It will be appreciated that one or more tabs can be connected to one or more locations along the antenna 30. When the tab is pulled, the tab serves to sever the pattern of the antenna 30 at one or more locations along the antenna 30 where the tab is connected. By severing the pattern of the antenna, the tab serves to change the effective electrical length of the antenna 30, thereby further optimizing the antenna 30 for a particular wires network of setting.

In one embodiment, molded lining 20 provides a substrate for the antenna 30 and can comprise non-conductive surface that provides a dielectric support for the antenna 30. The supporting substrate provides a dielectric load $\in_r$ to the antenna 30 so that the antenna 30 can achieve a prescribed electrical length using a shorter physical length than otherwise would be required if the same antenna 30 were disposed in free space.

A connection point 40 is mounted to molded lining 20. While the connection point 40 can be mounted in practically any location on molded lining 20, connection point 40 is preferably mounted along one of the external edges of molded lining 20 and/or on the interior surface of molded lining 20.

Figure 4:
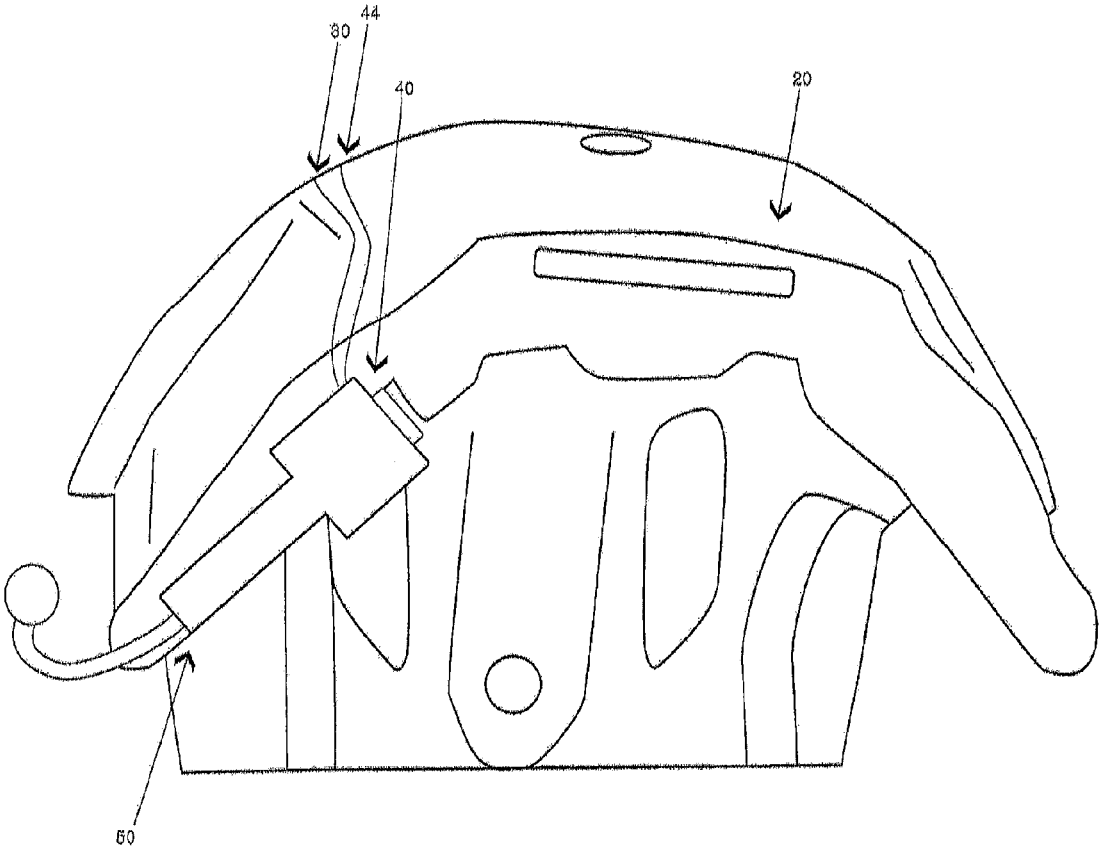
FIG. 4 depicts an exemplary embodiment of the molded lining having a mobile communication device attached to the molded lining and connected to the connection point and antenna.
Figure 5:
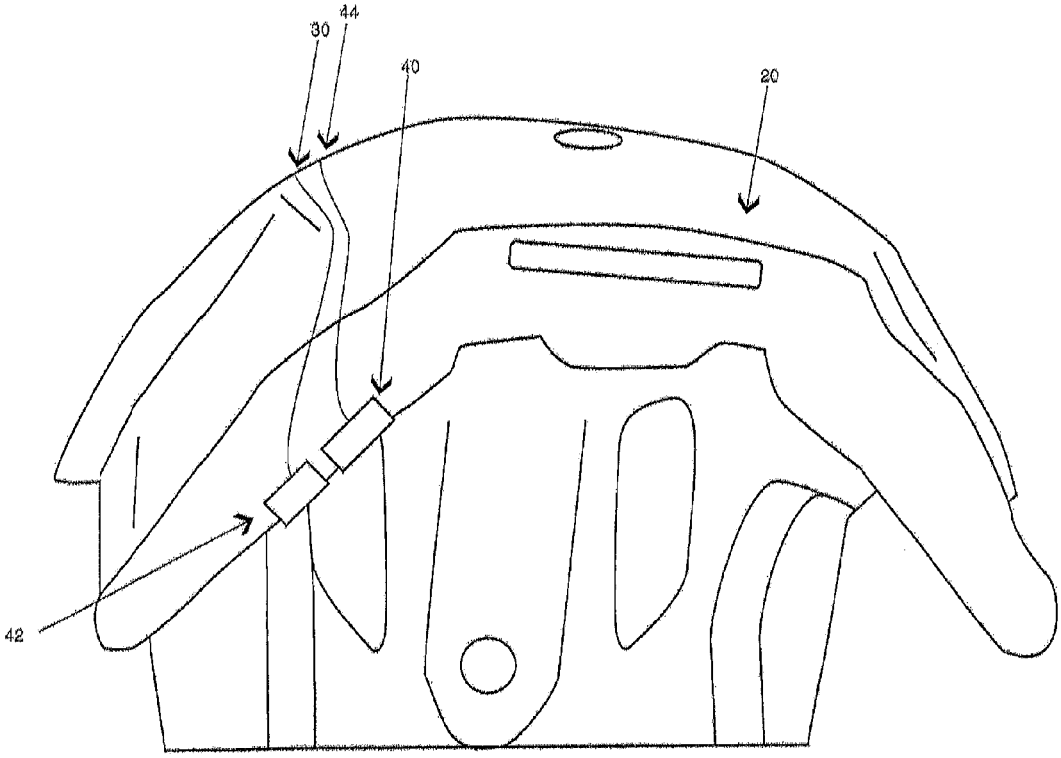
FIG. 5 depicts an exemplary embodiment of the molded lining having two distinct connection points.

Connection point 40 is connected to the proximal end 32 of antenna 30. Connection point 40 is configured to receive a connection from a mobile communication device 50, such as a Bluetooth headset. FIG. 4 depicts an exemplary embodiment of molded lining 20 having a mobile communication device 50 (such as a Bluetooth headset) attached to the molded lining 20 and connected to connection point 40 and antenna 30. By connecting with connection point 40, mobile communication device 50 can in turn connect with and link to antenna 30, and thereby harness the additional reception and/or transmission capabilities afforded by antenna 30. In one arrangement, where antenna 30 is embodied as a plurality of antennas, each proximal end 32 of each of the respective antennas 30 will connect to connection point 40. Thus, mobile communication device 50 (or a plurality of communication devices) can connect to one or more of the plurality of antennas 30, in the manner described herein. In another arrangement, each of the plurality of antennas can connect to a respective connection point 40, thereby resulting in a molded lining 20 having multiple connection points 40, each of which is connected to a different antenna. For instance, as depicted in FIG. 5, in one arrangement molded lining 20 has two distinct connection points, 40 and 42. Connection point 40 is connected to antenna 30, such as an FM antenna, as described above. As described below, the connection point 42 can be connected to another antenna 36, such as an RF/Bluetooth antenna. As described below, the performance of the device can be improved and optimized by strategically locating the antenna 36 and the connection point 42 which is attached to one end of the antenna 36.

In such an arrangement mobile communication device 50, or any other such device or plurality of devices, can utilize either or both of connection points 40 and 42 and their respective antennas 30 and 36.

In one embodiment, connection point 40 can be configured as a female-type connector, while mobile communication device 50 is configured to include a male-type connector (e.g., a snap button). Thus, inserting the male-type connector of mobile communication device 50 into the female-type connector of connection point 40 results in a link between the mobile communication device 50 and the antenna 30, as described above. It should be noted that connection point 40 and mobile communication device 50 can connect to one another in any number of ways, using any number of different connection types. Furthermore, connection point 40 can be interchangeable such that a user may replace one connection point with another connection point in order to enable configuration with various models and types of mobile communication devices 50.

When mobile communication device 50 connects to antennas 30 and 36, in the manner described above, the RF circuit of the mobile communication device 50 connects to and utilizes antennas 30 and 36 to transmit and/or receive electromagnetic and/or radio waves and/or signals. As noted above, while in one embodiment the antennas 30 and 36 are utilized to improve the transmission and/or reception of a Bluetooth communication device, antennas 30 and 36 can be similarly configured to improve the transmission and/or reception of any device using practically any wireless communication protocol or method (e.g., 802.11b/g/n, etc.).

As such, the antenna 30 can be utilized by the mobile communication device 50 and provide enhanced communicative ability for the wearer of a helmet constructed in accordance with the embodiments described herein to other communicative devices, whether mobile or land-based.

The helmet can be generally broken into different regions including front and rear regions and a pair of side regions that extend between the front and rear regions. Within the side regions, there are different areas or regions including an area that is in front of the user's ear, an area that is behind the user's ear and a region that is above the user's ear.

Figure 6:
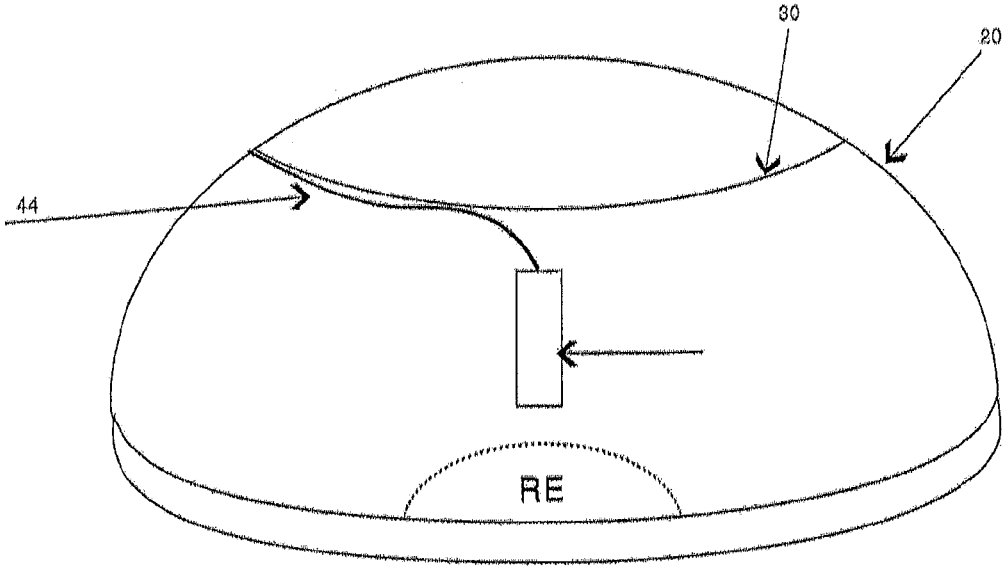
FIG. 6 is a side elevation view of a molded lining having a pair of antennas attached thereto.

In accordance with the present invention and as shown in FIG. 6, the antenna 36 that is disposed within the molded lining 20 of the helmet is located above the ear (left ear or right ear or both in some antenna designs) to provide optimal performance in terms of communication range. For example, in one embodiment, the antenna, such as antenna 36 (RF/Bluetooth antenna) shown in FIG. 6, is embedded within the helmet at a location that is above the right ear (or left ear) of the user when the helmet is worn. In FIG. 6, the right ear region is identified as "RE". FIG. 6 also shows the cable 44 or the like that connects the antenna 36 to the communication device 50.

Similarly, in one embodiment, the antenna, such as antenna 36 (RF/Bluetooth antenna), is embedded within the helmet at a location that is above the right ear (or left ear) of the user when the helmet is worn. It will be appreciated that this configuration can be used in situations where the embedded antenna is formed of a single antenna or multiple antennas (i.e., in combination with embedded antenna 30) as described herein.

In other words, the antenna (e.g., antenna 36) and optionally, the connection point (connection point 42) are located above the left ear or right ear of the user to enable line of sight to other bikers, including back rider, adjacent biker and front biker.

As mentioned herein, the antenna can be any number of different types of antennas that have different shapes and different constructions. For example, the antenna can be a vertical antenna that can be fed from either the top side or the bottom side; the antenna can be a printed PCB antenna; or the antenna can have a different configuration. However, regardless of the physical design and construction of the antenna, the antenna is located along at least one side of the helmet above the left ear or above the right ear, thereby yielding optimal performance. In addition, while one embodiment includes two antennas 30, 36, it will be appreciated that in another embodiment, only one antenna, such as antenna 36, can be present.

Side sections of the helmet above the left or right ear represent high points on the helmet and therefore, positioning the antenna in these locations yields more optimal performance. These locations are thus along the sides of the helmet in the upper regions thereof near the top of the helmet and permit improved communication between spaced apart communication units.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. An enhanced protective helmet comprising:

an outer shell;

a molded lining providing a substrate for one or more antennas, and including a non-conductive surface that provides a dielectric support for the one or more antennas, wherein the molding lining is disposed within the outer shell and contoured to surround a human head;

a first antenna configured in an elongated form having a proximal end and a free end, the first antenna being supported by the molded lining and provided a dielectric load from the supporting substrate and achieving a prescribed electrical length using a respective physical length as a function of the dielectric load;

a connection point mounted along an external edge of the molded lining or mounted on an interior surface of the molded lining, the connection point communicatively connected to the proximal end of the first antenna and configured to removably connect to a first mobile communication device and further configured to removably connect to a second mobile communication device, thereby linking one of the first and second mobile communication devices to the first antenna when the respective first mobile communication device or the second communication device is removably connected by a user to the connection point;

a second antenna configured in an elongated form having a proximal end and a free end, the second antenna being supported by the molded lining and provided a dielectric load from the supporting substrate and achieving a prescribed electrical length using a respective physical length as a function of the dielectric load, whereby the connection point is communicatively connected to the proximal end of the second antenna, wherein one of the first and second mobile communication devices is linked to the second antenna when the respective first mobile communication device or the second communication device is removably connected by a user to the connection point, and further wherein at least the second antenna is disposed in a helmet location that is along a side of the helmet above one of a left ear and a right ear of a user when the helmet is worn by the user.

2. The helmet of claim 1, wherein the molded lining comprises shock-absorbent material.

3. The helmet of claim 1, wherein at least one of the first and second antennas is supported across a surface of the molded lining.

4. The helmet of claim 1, wherein at least one of the first and second antennas is embedded within the molded lining.

5. The helmet of claim 1, wherein at least one of the first and second antennas is a frequency modulation (FM) antenna.

6. The helmet of claim 1, wherein at least one of the first and second antennas is a radio frequency (RF) antenna.

7. The helmet of claim 1, wherein at least one of the first and second connections points is a female-type connector.

8. The helmet of claim 1, wherein at least one of the connection points is interchangeable with an alternate connection point.

9. An enhanced protective helmet comprising:

a shaped foam element contoured to surround a human head, the shaped foam element comprising a shock-absorbent material and including a substrate for one or more antennas, and including a non-conductive surface that provides a dielectric support for the one or more antennas;

a first antenna configured in an elongated form having a proximal end and a free end, the first antenna being supported by the shaped foam element; and provided a dielectric load from the supporting substrate and achieving a prescribed electrical length using a respective physical length as a function of the dielectric load; and a connection point mounted along an external edge of the shaped foam element or mounted on an interior surface of the shaped foam element, the connection point communicatively connected to the proximal end of the first antenna and configured to removably connect to a first mobile communication device and further configured to removably connect to a second mobile communication device, thereby linking one of the first and second mobile communication devices to the first antenna when the respective first mobile communication device or the second communication device is removably connected by a user to the connection point; wherein at least the first antenna is disposed in a helmet location that is along a side of the helmet generally above one of a left ear and a right ear of a user when the helmet is worn by the user;

a second antenna configured in an elongated form having a proximal end and a free end, the second-antenna being supported by the shaped foam element, and provided a dielectric load from the supporting substrate and achieving a prescribed electrical length using a respective physical length as a function of the dielectric load; and wherein one of the first and second mobile communication devices is linked to the second antenna when the respective first mobile communication device or the second communication device is removably connected by a user to the connection point.

10. The helmet of claim 9, wherein at least a portion of the first antenna is embedded within the shaped foam element.

11. The helmet of claim 9, wherein the first antenna is a frequency modulation (FM) antenna.

12. The helmet of claim 9, wherein the first antenna is a radio frequency (RF) antenna.

13. The helmet of claim 12, wherein the first antenna is a Bluetooth (BT) antenna.

14. The helmet of claim 9, further including a second antenna that comprises an elongated antenna having a proximal end and a free end, the second antenna being supported by the molded lining and a second connection is provided and is communicatively connected to the second antenna.

15. The helmet of claim 14, wherein the second antenna is embedded within the shaped foam element.

16. An enhanced protective helmet comprising:

an outer shell;

a molded lining providing a substrate for one or more antennas, and including a non-conductive surface that provides a dielectric support for the one or more antennas, wherein the molding lining is disposed within the outer shell and contoured to surround a human head;

a first antenna configured in an elongated form having a proximal end and a free end, the first antenna being supported by the molded lining and provided a dielectric load from the supporting substrate and achieving a prescribed electrical length using a respective physical length as a function of the dielectric load;

a first connection point mounted along an external edge of the molded lining or mounted on an interior surface of the molded lining, the first connection point communicatively connected to the proximal end of the first antenna, and configured to removably receive a first connection from a first mobile communication device, and further configured to removably receive a second connection from a second mobile communication device, thereby linking one of the first and second mobile communication devices to the first antenna when the respective first mobile communication device or the second communication device is removably connected by a user to the first connection point;

a second antenna configured in an elongated form having a proximal end and a free end, the second antenna being supported by the molded lining and provided a dielectric load from the supporting substrate and achieving a prescribed electrical length using a respective physical length as a function of the dielectric load, whereby the first connection point is communicatively connected to the proximal end of the second antenna, a second connection point mounted along an external edge of the molded lining or mounted on an interior surface of the molded lining, the second connection point communicatively connected to the proximal end of the second antenna, and configured to removably receive a first connection from the first mobile communication device, and further configured to removably receive a second connection from the second mobile communication device, thereby respectively linking one of the first and second mobile communication devices to the second antenna when the first mobile communication device or the second communication device is removably connected by a user to the second connection point;

wherein one of the first and second mobile communication devices is respectively linked to the second antenna when the first mobile communication device or the second communication device is removably connected by a user to the second connection point, and further wherein at least the second antenna is disposed in a helmet location that is along a side of the helmet above one of a left ear and a right ear of a user when the helmet is worn by the user.

* * * * *